United States Patent [19]

Brook et al.

[11] 4,147,253

[45] Apr. 3, 1979

[54] SUPPLY PACKAGE FOR WET-IMPREGNATED MULTIFILAMENT ROVING

[75] Inventors: Richard L. Brook; Joseph E. Gaske, both of Mt. Prospect; Thomas E. Kearney, Oak Park; Russell D. Wydeen, Palatine, all of Ill.

[73] Assignee: DeSoto, Inc., Des Plaines, Ill.

[21] Appl. No.: 805,176

[22] Filed: Jun. 9, 1977

[51] Int. Cl.[2] ..... B65D 81/24; B65H 54/00

[52] U.S. Cl. ..... 206/205; 206/410; 242/18 G; 242/159; 428/35

[58] Field of Search ..... 428/35, 36; 206/205, 206/389, 410; 242/18 G, 159

[56] References Cited

U.S. PATENT DOCUMENTS

| | | | |
|---|---|---|---|
| 3,844,916 | 10/1974 | Gaske | 260/75 UA |
| 3,850,294 | 11/1974 | Phillips et al. | 206/205 |
| 3,915,301 | 10/1975 | Gray et al. | 206/410 |
| 3,983,997 | 10/1976 | Warshaw | 206/389 |

*Primary Examiner*—William R. Dixon, Jr.
*Attorney, Agent, or Firm*—Dressler, Goldsmith, Clement, Gordon & Shore, Ltd.

[57] ABSTRACT

A supply package for wet-impregnated multifilament roving is provided in which the multifilament roving is impregnated with a curable liquid having a tack less than about 6 (measured on a Thwing-Albert inkometer) in an amount at least sufficient to fill the spaces between the filaments in the roving, but not in excess of about a 3:2 ratio of curable liquid to fiber, by volume. This impregnated roving is way wound onto a cylinder to provide a crossing angle between the rovings in adjacent layers of at least about 10° to provide free volume storage capacity between the angled rovings which accepts any liquid which may run off. In this manner the wet-impregnated roving can be stored wet in the way wound cylinder and easily withdrawn therefrom when needed.

7 Claims, No Drawings

SUPPLY PACKAGE FOR WET-IMPREGNATED MULTIFILAMENT ROVING

The present invention relates to the production of fiber-reinforced composites, and particularly to the provision of a supply package from which wet-impregnated multifilament roving can be withdrawn as desired.

The production of fiber-reinforced composites has taken on increasing importance, especially since structures of great strength and light weight can be formed. However, the production of such composites has been difficult and expensive, the proportion of resin has been excessive and poor impregnation and detrimental resin flow have been encountered.

The conventional technique has involved the use of fibrous layers impregnated with viscous tacky resin, these being stored between nonadhesive sheets which are removed immediately prior to use. The sticky resin-containing fibrous layer is laid up, usually by hand, and then heat and pressure are used to cure the resin. In some instances polyester resins which cure in the absence of pressure have been used, but these are slow curing and air inhibited. In addition to the cost and lack of reproducibility which characterize hand manipulation, the proportion of resin needed was excessive which increases expense and reduces the strength of the composite. Also, resin flow during the cure adds further complexity.

The art has also attempted to apply the fibers dry, as by winding or braiding dry yarn, and then applying the liquid resin after the fibers were in place. This has often required twisted yarns and the resin impregnation has been difficult because the fibers are not thoroughly wetted and uniform and complete impregnation has not been possible.

Application of the wet resin to the dry yarn as it is being applied has also been tried, but fiber wetting has often been poor and the mechanical compexities have been excessive.

A significant advance by Richard L. Brook has enabled the use of preimpregnated roving in which the roving is preimpregnated with a thermosetting resin in a semi-solid form and overcoated with a thermoplastic film. The use of such preimpregnated roving has provided considerable progress, particularly in enabling the use of textile machinery in the application of the preimpregnated roving.

Nonetheless, the goal has always been to be able to store and handle a preimpregnated roving with the resin impregnant being in wet condition. With viscous, tacky resin, the impregnated roving could not be removed from a package unless release sheets were placed between the roving strands. With resins of low viscosity, the resin would flow away from the rovings by gravity when the package was stored. Thus, wet storage was not possible heretofore, and it is this previously impractical goal which is the objective of this invention.

It is desired to point out that low viscosity curable resin systems, and particularly radiation curable resin systems, are well known, but the possibility of using these to impregnate a roving which is to be stored wet has not hitherto been considered to be possible.

In accordance with this invention, a supply package for wet-impregnated multifilament roving is provided by having the multifilament roving impregnated with a curable liquid having a tack less than about 6 on a Thwing-Albert inkometer, the curable liquid being present in an amount at least sufficient to fill the spaces between the filaments in the roving, but not in excess of about a 3:2 ratio of curable liquid to fiber, by volume. This impregnated roving is way wound onto a cylinder to provide a crossing angle between the rovings in adjacent layers of at least about 10°, and this provides free volume storage capacity between the angled rovings which is capable of accepting any of the liquid impregnant which may run off a roving or be squeezed from it during package winding. In this way, the wet-impregnated roving can be easily withdrawn from the cylinder as desired. The curable liquid is desirably of low viscosity which is identified by a room temperature viscosity of less than about 3000 centipoises. The supply package is normally constituted by a cylinder of wound roving packaged within a liquid-impermeable wrapper, and in preferred practice, the curable liquid is curable with actinic (including ultraviolet) light and the wrapper is opaque to actinic light. The rovings can be wound on a core in conventional fashion, or the wound cylinder can be hollow to provide a center feed supply package.

Referring more particularly to the fibrous roving, any multifilament roving can be used. The fibers are preferably of great length, but short fibers, e.g., of staple length, can be used. Glass fibers, carbon fibers, natural fibers, such as cotton, and synthetic fibers such as polyamide or polyimide fibers, are all useful. These fibers can be sized, if desired, or strengthened with binder particles. The point is that the technique of this invention is applicable to any multifilament roving and is not dependent on any particular selection. The form of the roving is also secondary. Untwisted rovings are primarily contemplated since these lead to the strongest composites and are most easily impregnated. Nonetheless, some twist is tolerable and while the more twist the less satisfactory, this invention will perform its function regardless of twist. Glass filaments grouped together into an untwisted bundle will be used as illustrative.

The curable liquid can be any liquid which can be cured in any fashion so long as it possesses a room temperature tack which is quite low, namely, less than about 6 on a Thwing-Albert inkometer. As will be evident, substantially the entire liquid must be curable because a nonporous composite cannot be formed when a significant portion of the liquid volatilizes under curing conditions.

Curable liquids which contain ethylenic unsaturation for cure are particularly contemplated since these are stable and storable, and yet subject to rapid cure, particularly upon subjection to radiation, actinic light radiation being primarily contemplated, though ionizing radiation is also useful, especially where carbon fibers are used which limits penetration of actinic light.

Ultraviolet-curable ethylenically unsaturated liquids are well known, but it is particularly preferred to employ polyacrylates which have been prereacted with a small proportion of monosecondary aliphatic amine, and especially diethyl amine or dibutyl amine, so as to form an adduct containing residual unsaturation. From the standpoint of the liquid which is subjected to ultraviolet light exposure, it is preferred to have from 0.5% to 5%, more preferably from 1.0% to 4% of reacted amine present, all as more fully described in U.S. Pat. No. 3,844,916. The preference is based on the fact that such polyacrylate systems cure rapidly on ultraviolet exposure in the presence of air to provide good cured properties. However, one can proceed in an inert gas blanket and use heat and/or ionizing radiation to provide the cure.

While actinic light cure is preferred, one can incorporate a free radical polymerization catalyst, such as benzoyl peroxide, into the liquid and cure the system with heat. This heat can be applied radiantly or with an oven, and the heat can be applied as winding proceeds or after it is completed.

Heat can be combined with the actinic light, either simultaneously or subsequent to exposure, the latter being preferred when the polyacrylate is hydroxy functional and when a minor proportion of a thermally reactive phenoplast/or aminoplast resin (from 3–30% based on the total weight of resin) is present.

The invention will be illustrated using triethylene glycol dicarylate preadducted with diethyl amine, this adduct being blended with a diacrylate of a diglycidyl ether of a bisphenol.

When light in or near the ultraviolet range is intended to provide the cure, a ketonic photosensitizer is usually added, such as benzophenone or a benzoin ether.

The proportion of liquid on the fiber in the roving can vary considerably, so long as there is enough to fill the spaces between the filaments in the roving. Confining attention to glass fiber, this invention can effectively employ 20%–35% by weight of resin, balance glass fiber, and this yields stronger and less costly fiber composites, than does conventional practice where generally larger proportions of resin are required. The same advantage is obtained using other fibers, but the numbers change since the other fibers do not have the same density as glass.

Way winding is itself conventional and it creates a wound cylinder in which the rovings in each layer are widely spaced and the rovings in adjacent layers cross one another at an angle of at least about 10°, preferably at least about 15°, so as to provide a free volume storage capacity between the angled rovings to accept any liquid which may run off or be squeezed from a roving. In this invention, it has been found that the surface tension between the fibers and the liquid impregnant in combination with the open spaces between the rovings effectively prevents the low tack low viscosity liquid from flowing away from the rovings.

The wound cylinder is packaged within a liquid-impermeable wrapper for storage. A simple aluminum foil wrapper is adequate, especially since the opaque foil prevents actinic radiation from activating the ethylenic unsaturation in a photocurable system promoting premature cure and resultant poor storage stability. The wound cylinder can contain a core, such as a cardboard core, or the core can be removed to enable the roving to be withdrawn from the hollow center of the cylinder which then forms a center feed supply package.

The illustrative system presented hereinafter is excellently stable on storage and is yet rapidly curable on exposure to actinic light near the ultraviolet range in the presence of air.

Withdrawal of the impregnated wet roving occurs easily. The selection of a low tack liquid and way winding eliminates the impossible unwinding problem which exists if conventional tacky resinous liquids are used.

Winding of the wet roving into a final fiber composite is itself well known, such winding leaving little free volume so that a nonporous cured product is obtained. The detailed production of the wound and cured composite is not a feature of this invention and is itself broadly known, but it will be appreciated that when the final form is wound, it is desirable to minimize the free volume in the winding so that the winding tension will normally be greater than that used for the winding of the supply package.

The invention is illustrated but not restricted to the following examples, it being understood that all parts and percentages herein are by weight unless otherwise stated.

EXAMPLE

| Parts | | |
|---|---|---|
| 46.76 | Diacrylate of diglycidyl ether of bisphenol A (epoxide equivalent weight of the starting diglycidyl ether = 185) | |
| 48.28 | Triethylene glycol diacrylate | Preadducted with one another |
| 2.65 | Diethyl amine | |
| 1.77 | Benzophenone | |

The above components are mixed together to provide an ultraviolet light-curable liquid having a room temperature viscosity (25° C.) of 600 centipoises.

This liquid mixture has a tack of 2.4 at 100 R.P.M., (1.8 at 1000 R.P.M.) at 25° C. using the Thwing-Albert inkometer and is used for the impregnation of a fiberglass roving by heating the same to 80° C. where the viscosity is reduced to aid penetration of the roving.

A fiberglass roving designated ECK 37-15, continuous end roving with epoxy compatible finish, is withdrawn from a center feed package and is passed over a cylindrical idler roll the lower portion of which is immersed in the hot liquid mixture. This idler roll serves to transfer the liquid mixture to the roving which moves at a speed of 72 feet per minute. The take up of liquid is about 30% by weight of liquid to 70% of glass. As little as about 20% liquid to 80% glass can be used in this invention.

The impregnated roving is wound onto a cylindrical cardboard core having an outside diameter of 3 inches and a length of 11 inches using a traveling take-up which provides 3-way winds with each traverse. This provides a crossing angle of about 30° between the rovings of adjacent layers in the wound package. The winding tension is minimal.

The wound package is sealed within an aluminum foil wrapper.

The impregnated roving is stable within the package and can be unwound therefrom at any time. The liquid impregnant is of low viscosity and flows easily, but it does not flow within the package, so the roving which is withdrawn remains uniformly impregnated. The low tack enables withdrawal without perceptible effort or damage to the roving filaments.

When the impregnated roving is withdrawn, it is transferred directly from the supply package onto a turning form with the adjacent windings being close together and parallel to one another so that there is little free volume on the form. The windings on the form are subjected to ultraviolet light exposure as winding proceeds to produce a cured piece. Winding is at a rate of 135 feet per minute and a 200 watt per inch mercury vapor lamp 12 inches in length and unfocused was used, the lamp being maintained at a distance of 8 inches from the surface being wound. A winding tension of about 5 pounds was used, and a strong, well cured composite was formed.

Under the same conditions of winding, a speed of 215 feet per minute was used with exposure to a Berkey Technical Co. 5 kilowatt "Addalux" diazo or photopolymer lamp being used during winding to achieve satisfactory conversion to a solid composite form. A Xenon Corporation 2 kw pulsed xenon arc was also used to convert the wet-wound composite after it was wound. This post conversion was observed to form a solid composite to a depth of about ¼ inch.

As a matter of interest, the Berkey diazo lamp generates predominantly visible light (4177 A°) and the photopolymer lamp generates light at predominantly 3650 A°.

The invention is defined in the claims which follow.

We claim:

1. A supply package for wet-impregnated multifilament roving comprising multifilament roving impregnated with a curable organic liquid having a tack less than about 6 on a Thwing-Albert inkometer, said roving containing said curable liquid in an amount at least sufficient to fill the spaces between the filaments in the roving, but not in excess of about a 3:2 ratio of curable liquid to fiber, by volume, said impregnated roving being way wound onto a cylinder to provide a crossing angle between the rovings in adjacent layers of at least about 10° to provide free volume storage capacity between the angled rovings to accept any of said liquid which may run off a roving, whereby said wet-impregnated roving can be easily withdrawn from the cylinder and said way wound cylinder being packaged within a liquid-impermeable wrapper.

2. A supply package for wet-impregnated multifilament roving as recited in claim 1 in which said curable liquid has a room temperature viscosity of less than about 3000 centipoises.

3. A supply package for wet-impregnated multifilament roving as recited in claim 1 in which said curable liquid is curable with actinic light and said wrapper is opaque to actinic light.

4. A supply package for wet-impregnated multifilament roving as recited in claim 1 in which said wound cylinder is hollow to provide a center feed supply package.

5. A supply package for wet-impregnated multifilament roving as recited in claim 1 in which said curable liquid comprises a polyacrylate at least a portion of which has been adducted with a monosecondary aliphatic amine to produce an unsaturated adduct, and a ketonic photosensitizer rendering said liquid curable upon actinic light exposure.

6. A supply package for wet-impregnated multifilament roving as recited in claim 5 in which said aliphatic amine is selected from diethyl amine and dibutyl amine and is used in an amount of from 0.5% to 5% of the polyacrylate in said curable liquid.

7. A supply package for wet-impregnated multifilament roving as recited in claim 1 in which the fibers of said roving are glass fibers and said liquid is used in an amount of from 22% to 35% of the total weight of liquid and glass in said roving.

* * * * *